US005465463A

United States Patent [19]

Lautenschläger

[11] Patent Number: 5,465,463

[45] Date of Patent: Nov. 14, 1995

[54] CORNER CABINET HINGE

[75] Inventor: Reinhard Lautenschläger, Reinheim, Germany

[73] Assignee: Mepla-Werke Lautenschläger GmbH & Co. KG, Germany

[21] Appl. No.: 244,526

[22] PCT Filed: Sep. 30, 1993

[86] PCT No.: PCT/EP93/02679

§ 371 Date: May 31, 1994

§ 102(e) Date: May 31, 1994

[87] PCT Pub. No.: WO94/11605

PCT Pub. Date: May 26, 1994

[30] Foreign Application Priority Data

Nov. 17, 1992 [DE] Germany ..... 42 38 791.4

[51] Int. Cl.[6] ..... E05D 7/04

[52] U.S. Cl. ..... 16/236; 16/287; 16/369

[58] Field of Search ..... 16/281, 286, 287, 16/291, 369, 370, 236

[56] References Cited

U.S. PATENT DOCUMENTS 1,775,789 9/1930 Taffe .

FOREIGN PATENT DOCUMENTS 0463439 1/1992 European Pat. Off. .

1404141 5/1965 France ..... 16/369

3341350 5/1985 Germany ..... 16/370

4023790 2/1992 Germany .

0484707 12/1975 U.S.S.R. .

*Primary Examiner*—Mark Rosenbaum

*Assistant Examiner*—Kenneth J. Hansen

[57] ABSTRACT

Hinge for hanging the free panel of a bipartite corner-cabinet door on the panel that is hinged to the supporting wall of the carcase. The hinge has two leaves associated one with each of the door panels and the leaves can pivot relative to one another on a pivot pin passing through aligned bores provided at the meeting arrises of the door. Each of these hinge leaves has at least one angular appendage running across the front edge of the associated door panel to a point near the door's arris, and the bores for the hinge pins are provided in the staggered knuckles of the hinge leaves. The two hinge leaves are in the form of elongated supporting arms to each of which the end of one link of a pair of links is articulated, the other ends of the links being articulated to one another. At least one of the links is articulated at the hinge-leaf end to a thruster guided for displacement relative to the supporting arm in the longitudinal direction thereof and urged resiliently to an end position, the length of the two links being such that, in their outstretched position associated with the closed position of the door, they hold the door panel in a position aligned at right angles to one another, although an additional turning of the free door panel in the sense of a reduction of the right angle included between the door panels is possible by overdrawing the free panel within the range allowed by thruster or thrusters.

12 Claims, 3 Drawing Sheets

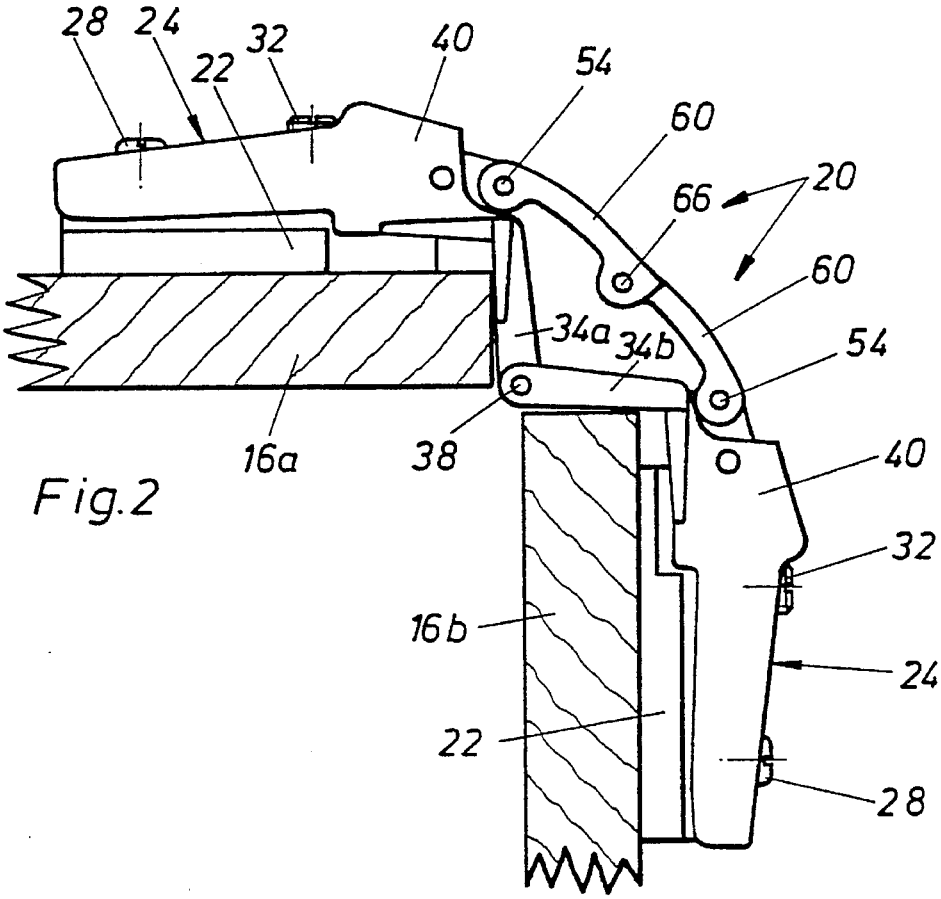
Fig.2
Fig.3
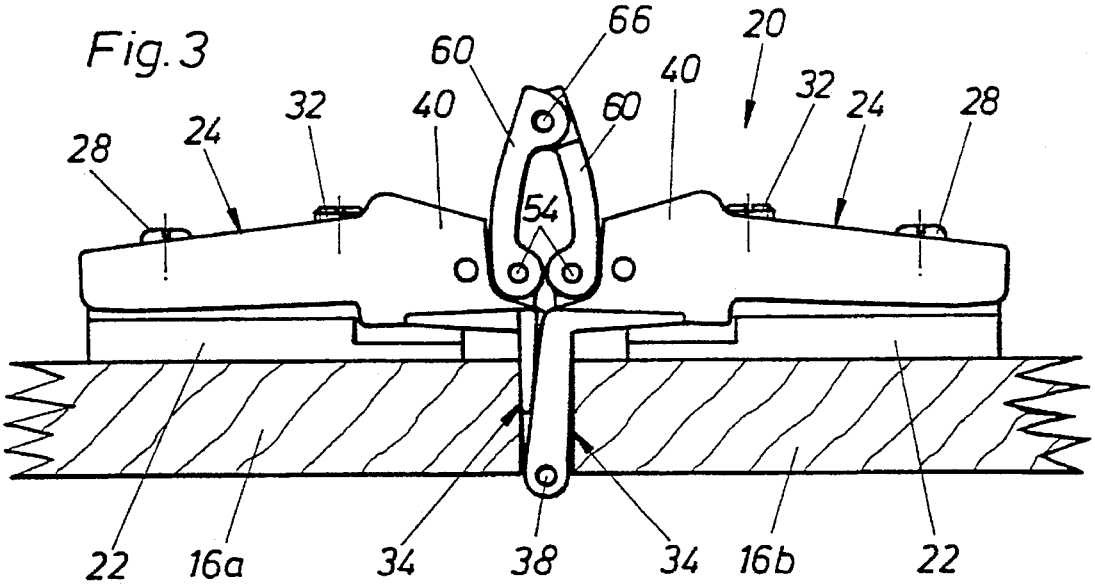

CORNER CABINET HINGE

BACKGROUND OF THE INVENTION

The invention relates to a hinge for hanging the free panel of a two-panel corner cabinet door on the panel which is in turn hinged on the carcase supporting wall. It consists of two hinge halves, one associated with each door panel, which by means of a hinge pin passed through aligned bores provided at the front arrises at which the panels meet can be swung approximately 90° from the position in which the panels are approximately at right angles to one another when the corner cabinet is closed, to a position in which they are in line and substantially parallel when the corner cabinet door is opened. Each of the two hinge halves has angular knuckle arms reaching across the front edges of their associated panels as far as their front arrises, and the bores for the hinge pins are provided in their staggered ends.

Such corner cabinets, which complete the corner area of two rows of built-in cabinets hung on walls at right angles to one another, are used especially in built-in kitchen cabinet plans, both in the floor-mounted cabinets and in the wall-hung cabinets. The door closing the corner cabinet carcase is divided, on the basis of space requirements, into two panels, of which the one panel is attached by conventional hinges—self-closing hinges as a rule—to a wall of the corner cabinet carcase, while the second, free panel in turn is hinged to the first panel hung on the carcase, such that, when the door is closed, it is at a right angle to the first panel, but after the cabinet is opened it can be swung to a position in line with and parallel to the first panel. Originally so-called piano hinges were used for connecting the two panels, but they have the disadvantage that no self-closing mechanism nor any means for preventing them from being opened too far can be incorporated in them so as to hold the free panel against the associated part of the carcase when the door is closed. Even when the panel hung on the carcase was hung with normal self-closing hinges, the problem of holding the free door panel closed then had to be solved by a separate self-closing mechanism, such as a magnetic self-closer, for example. Since self-closing mechanisms that are separate from the corresponding hinges have components to be attached to the cabinet carcase which are visible when the door panel is open and impair the appearance of the (open) corner cabinet and can interfere with access to it, special corner cabinet hinges of the kind mentioned above (DE-OS 37 29 531) were developed, in which the hinge halves joined pivotingly to one another are coupled by an elongated strap or stick-like connecting means which is held for pivoting on one hinge leaf and for longitudinal displacement on the other, the connecting element being not only part of a self-closing mechanism but also serving as a restraint which prevents the door panels from swinging relative to one another by more than a given angle. This proven corner cabinet hinge, however, has the disadvantage that the two hinge leaves are of different construction and have to be inserted on the back of the panels in mortises to be milled or drilled near the edge thereof. Also, the installation of the stick-like connecting means and of the parts of the self-closing mechanism which cooperate with it is difficult. Since corner cabinets form only a small percentage of kitchen furniture layouts, such corner cabinet hinges are needed relatively infrequently, so that corner cabinet hinges are expensive as a result of their complex construction, the small demand for them, and the complexity of their installation in comparison to normal cabinet hinges.

SUMMARY OF THE INVENTION

The invention, accordingly, is addressed to the problem of creating a corner cabinet hinge which will be simpler to install and which will function at least equally to the known corner cabinet hinge, but which furthermore will also be able to be produced at considerably lower cost.

Setting out from a hinge of the kind mentioned above, this problem is solved according to the invention in that the two hinge leaves are in the form of elongated supporting arms which are held adjustably on a mounting plate fastened on the inside of the corresponding door panel, that each hinge leaf is connected to one of a pair of links whose other ends are articulated to one another, and that at least one of the links is attached at its hinge-leaf end to a thruster guided for displacement relative to the supporting arm in the longitudinal direction thereof and urged resiliently to an end position. The length of the two links is such that in their outstretched state associated with the closed state of the door they hold the door panels at right angles to one another, although an additional turning of the free door panel is possible in the sense of a reduction of the right angle included between the door panels, within the range allowed by the thruster or thrusters, by pulling on the free door panel. In the hinge thus configured, therefore, the mounting plates known in connection with the fastening of normal hinges to the supporting wall of the carcase can be used, so that the creation of mortises in the door panels is unnecessary. Furthermore it is possible to adapt to different thicknesses of the panels by using mounting plates of different thickness.

In a preferred embodiment of the invention, the hinge leaf associated with the free door panel and the panel hung on the carcase are of identical configuration, resulting in still another cost saving.

It is desirable for the angular appendages each to have two parallel knuckles spaced laterally apart, the space between them being slightly larger than the width of a knuckle. The knuckles of the two hinge leaves can then be offset from one another in such manner that their ends carrying the bores overlap and thus the hinge pin can be inserted through the bores.

Especially advantageous is an embodiment in which one of the knuckles of each hinge leaf is disposed laterally in line with one of the lateral flanges of the supporting arm, while the other knuckle is offset outwardly opposite the other lateral supporting arm flange. Then, since the hinge leaves are installed confronting one another, it can be brought about by the appropriate selection of the lateral offset that the longitudinal central axes of the supporting arms will be in line, i.e., the mounting plates adjustably bearing the supporting arms on the door panels can be preinstalled on the door panels at the same level.

The supporting arms and the mounting plates adjustably holding them can be made the same as the supporting arms and corresponding mounting plates of conventional cabinet hinges for hanging doors on a cabinet carcase, except for the construction of the hinge linkage. For the mounting plates and the adjusting and fastening screws holding the supporting arm on the mounting plates, it will then be possible to make use of parts from the conventional line of hinges, which contributes to the further reduction of the cost of the corner cabinet hinge.

The thruster or thrusters are best disposed for longitudinal displacement in the end area of the supporting arm or arms at the angular appendage end, one end of the thruster protruding through an opening in the supporting arm, and on it the associated link is then articulated about an axis parallel to the axis of movement of the hinge. In this case the thruster is biased to a position largely retracted into the supporting arm by a pretensioned spring thrusting directly or indirectly against the inside of the supporting arm at one end and against the thruster at the other. The length of the link arms in the outstretched position when the corner cabinet door is closed is such that the thrusters hold the door panel precisely in the 90° position or, to achieve a certain pressure by the free panel against the carcase, at a slightly greater angle. The additional turning of the free door panel away from the carcase interior is made possible by connecting the link arms to the thrusters which are extensible and therefore make additional turning possible, the bias of their springs being made weaker than the bias of a self-closing mechanism in the hinges connecting the carcase-related door panel to the carcase, so that in any case first the necessary turning of the free door panel takes place before the self-closing mechanism of the hinges connecting the door panel to the carcase operates.

BRIEF DESCRIPTION OF THE DRAWINGS

The invention is explained in the following description of an embodiment in conjunction with the drawing, wherein:

FIG. 2 shows the area of the corner cabinet door situated inside of the broken-line circle in FIG. 1 with the corner-cabinet hinge of the invention in the closed position.

FIG. 3 is a view corresponding to FIG. 2, again showing the area of the door lying within the broken-line circle 3 in FIG. 1.

DETAILED DESCRIPTION OF THE INVENTION

Figure 1:
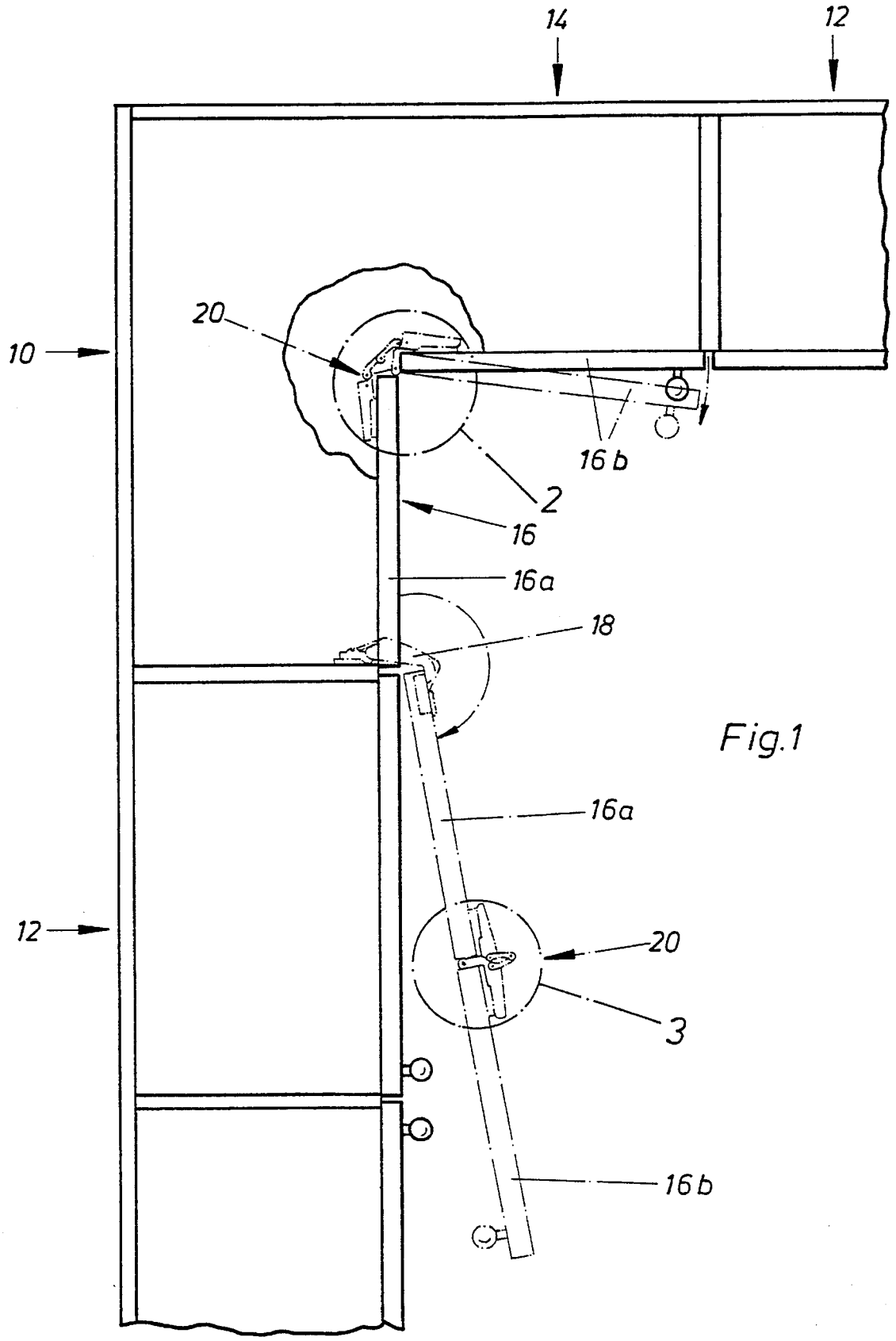
FIG. 1 is a top plan view of a corner cabinet with the countertop cut away at the corner, and with additional cabinets adjoining it on both sides. The door is shown in the closed position, plus the position of the free door panel slightly drawn away from the cabinet as it begins to open; the fully open position of the door as a whole is shown in broken lines.

In FIG. 1 there is seen a top view of a part of a corner cabinet 10 which forms part of a built-in cabinet layout, and which will be assumed in this case to be a corner wall-hung cabinet which is directly adjoined on both sides by additional (normal) wall-hung cabinets 12. The carcase 14 of the corner cabinet 10 is closed at the front by a door 16 which consists of two panels **16*a* and 16*b*, the first panel 16*a* being hinged by means of conventional wide-angle hinges 18 provided with a built-in self-closing mechanism to a lateral wall of the corner cabinet carcase, which is the lower horizontal wall in FIG. 1, but actually is the vertical left side wall of the corner cabinet carcase 14 as seen from the front. At the free vertical edge of this panel 16*a*, which panel 16*a* is hinged to the carcase, the second, or free, panel 16*b* is hung by means of the hinges 20 which are to be described in detail hereinbelow. Therefore it is possible to open the door 16 of the corner cabinet 10 by first opening the panel 16*b*, against the holding force of the hinges 20 biasing it, to the end position shown in the drawing against the panel 16*a*, to such an extent, in the manner indicated in broken lines, that the free vertical edge of panel 16*b* comes free of the associated front edge of the adjacent wall-hung cabinet 12. The degree to which the panel 16*b* can be opened is limited by a mechanism to be described further on to approximately the angle represented in dash-dotted lines, so that any further opening of the door 16 is possible only by opening the panel 16*a*. Then the holding force of the self-closing mechanism of the wide-angle hinges 18 is overcome and the entire door 16 can be turned largely effortlessly to the open position, also represented in broken lines in FIG. 1, wherein the two door panels 16*a* and 16*b*, which are then substantially in line with each other, are directly in front of the adjacent wall-hung cabinet 12 shown lower down in FIG. 1, and the interior of the corner cabinet 10** is easily accessible.

The corner cabinet hinges 20 forming the subject matter of the invention are shown in FIGS. 2 and 3 in the fully closed and fully open position, respectively, of the door 16. The hinge 20 is basically a single-joint hinge whose leaves associated with the door panels **16*a* and 16*b* are each in the form of a supporting arm mounted adjustably on a mounting plate 22 fastened on the inside of the respective door panel 16*a*, 16*b***. Since the mounting plates and hinge leaves associated with the door panels are of identical construction, and the manner in which the supporting arms are adjustably mounted on the mounting plate, as well as the configuration of the mounting plates themselves, are the same as those of conventional furniture hinges, it should suffice hereinafter to describe only the configuration of one of the supporting arms, doing so in regard to its adjustable mounting on the mounting plate, while for the mounting plate it will suffice to indicate that it can be taken from the line of mounting plates for normal cabinet hinges.

Figure 6:
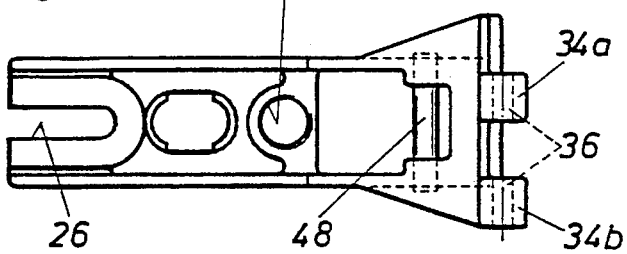
FIG. 6 is a bottom view of the hinge leaf seen in the direction of arrow 6 in FIG. 4.
Figure 5:
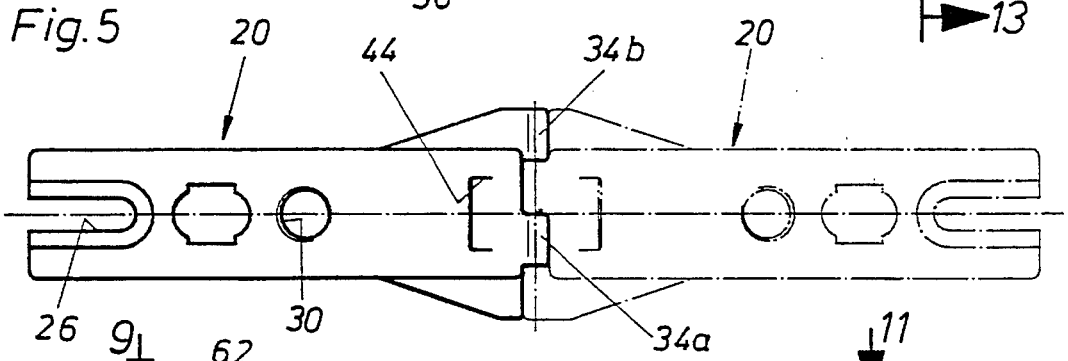
FIG. 5 is a top view of the hinge leaf seen in the direction of arrow 5 in FIG. 4.

The supporting arms have the usual elongated form of an inverted U-shape in cross section and have at the end remote from the joint, of the web connecting the two sides of the U-shape, an open-ended slot 26 (FIGS. 5 and 6) for a fastening screw 28 driven into the mounting plate 22 . A tap 30 is provided in the web toward the joint, and into it a threaded spindle is screwed, at whose lower end on the mounting plate side (not shown) a head is provided which is held for longitudinal displacement in an associated elongated slot open at the front end and having a width at its upper side that is less than the diameter of the head.

From the front end of the supporting arm an angular appendage 34 extends from the front end of the supporting arm, across the front edge of each associated door panel **16*a*, 16*b*, and all the way to a point near the front arris of the panel. This appendage in turn is divided into two parallel knuckles spaced apart laterally. One knuckle 34*b* is disposed laterally in line with one of the lateral flanges of the supporting arm 24, while the other knuckle is offset toward the outside with respect to the other lateral supporting arm flange. The distance between the two knuckles 34***a*, 34*b*, is selected such that knuckle 34*a* of the second hinge leaf fits into the space between them. In the free ends of the knuckles 34*a*, 34*b*, aligned bores 36 are provided for the pivot pin 38 joining the two hinge leaves together. It can be seen, especially in FIG. 5, that when the two hinge leaves have been installed opposite one another so that the knuckle 34*a* enters into the space between two knuckles of the other hinge leaf, a joint is obtained between the hinge leaves at which their longitudinal central axes are aligned.

Figure 13:
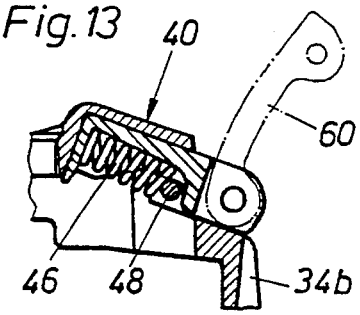
FIG. 13 is a longitudinal central section through the area of the hinge leaf that is within the broken circle 13, with the thruster inserted and biased by a spring.
Figure 4:
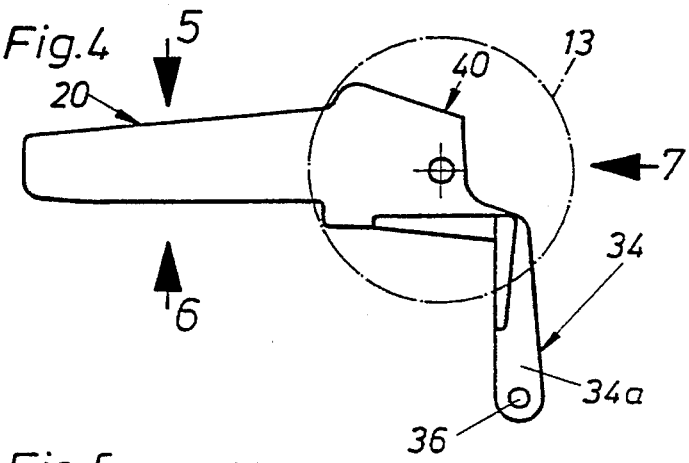
FIG. 4 is a side view of one of the two identically formed leaves of the hinge.
Figure 7:
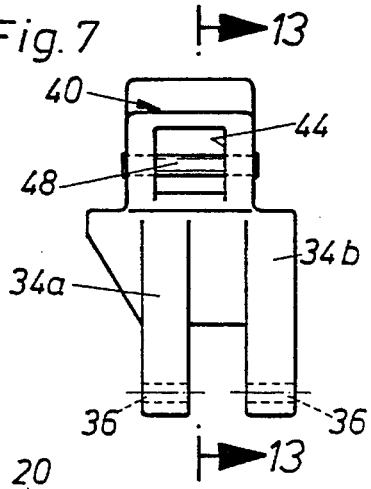
FIG. 7 is a view of the end of the hinge leaf seen in the direction of the arrow 7 in FIG. 4.
Figure 10:
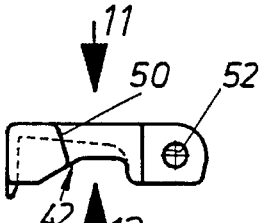
FIG. 10 is a side view of the thruster of the corner cabinet hinge according to the invention.
Figure 9:
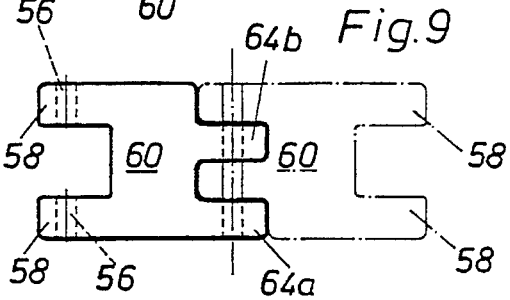
FIG. 9 is a top view of the link, seen in the direction of the arrow 9 in FIG. 8, the second link being also shown in broken lines.
Figure 11:
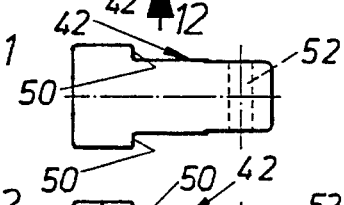
FIG. 11 is a top view of the thruster, seen in the direction of the arrow 11 in FIG. 10.
Figure 12:
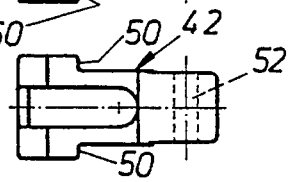
FIG. 12 is a bottom view of the thruster, seen in the direction of the arrow 12 in FIG. 10.

In a more spacious head end 40 of the supporting arm 24 a thruster 42, represented separately in FIGS. 10 to 12, is journaled in the manner shown in the cut-away drawing of FIG. 13. The thruster 42 protrudes partially from the supporting arm through a window-like opening 44 (FIG. 7) and is biased by a compressed coil spring 46 to a position set back as far as possible into the head end. The spring 46 for this purpose thrusts at one end against an end wall remote from the joint of an opening in the thruster 42, and at the other end against a pin 48 which runs across the interior of the head end and is riveted into the flanges of the supporting arm; this pin simultaneously secures the thruster 42 against escape from the open bottom of the head end. The extremity of the thruster within the head end is broadened on both sides and thus forms abutments 50 which limit the distance to which the thruster 42 can extend out of the window-like opening 44.

In its front end protruding from the window-like opening 44 the thruster has a bore 52 running parallel to the aligned bores 36, and pivot pins 54 reach through it, whose protruding outer ends are held in pivot bores 56 of bearing ears 58 of an associated link 60 straddling the thruster 42. At the ends of the links 60 remote from the thruster, two laterally spaced-apart ears 64*a* and 64*b* having aligned bearing bores are provided, whose distance apart is about equal to or only slightly greater than their width. These bearing ears 64*a* and 64*b* are offset to one side from the longitudinal central axis of the links such that the longitudinal central axes of the two links 60 coupled together by the pivot pin 66 (FIGS. 2 and 3) passing through the bores 62 in the lugs will be aligned. The bearing lugs 64*a* and 64*b* have, at their extremities adjoining the other link, flats 65 (FIG. 8) serving as abutments which contact one another when the links 60 are in the outstretched position. This brings it about that when the door 16 is opened the links 60 can rotate only to the position shown in FIG. 3, but not in the opposite direction between the edges of the panels 16*a* and 16*b*.

Figure 8:
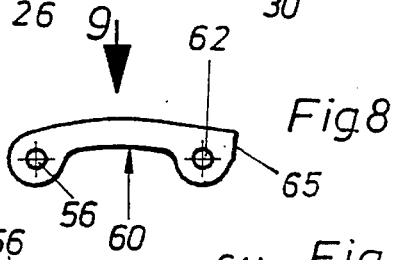
FIG. 8 is a side view of one of the links, which again are of identical shape.

The links 60, as well as the thruster 42, can expediently be made by injection molding from an appropriate plastic, in which case the ears 58 and lugs 64*a* and 64*b* are thickened, so that they have the enlarged dimensions necessary to accommodate the bores 56 and 62 as can be seen in FIG. 8. It is now clear that, when the door 16 is closed, the position of the panels 16*a* and 16*b* is limited, by the links 60 attached to the supporting arms 24, to the position including an angle of 90° or a slightly larger angle, as shown in FIG. 2. By pulling on the handle of the free panel 16*b*, this angle can be further reduced in the manner indicated in broken lines in FIG. 1 to an angle of less than 90° with respect to panel 16*a*, while the thrusters can be drawn out with additional tensioning of the coil spring 46 until the abutment surfaces 50 come in contact with the lateral limits of the window-like opening 44. Then the door 16 can be opened as a whole and brought into the open position indicated lower down in broken lines in FIG. 1, with the panels 16*a* and 16*b* in line with one another. At the same time the links 60 fold upwardly to the position shown in FIG. 3.

I claim:

1. A hinge for hanging a second, free panel of a bipartite corner cabinet door on a first panel hinged to a supporting wall of a cabinet carcase, the first panel and the second panel being hinged together at facing front panel edges thereof, the hinge comprising:

a first hinge leaf for securing to a first panel and a second hinge leaf for securing to a second panel, the first and second hinge leaves being pivotally connected to each other by a hinge pin passing through a first hinge bore located on the first hinge leaf and a second hinge pin located on the second hinge leaf, whereby said panels can be turned from a closed position in which the panels are held approximately at right angles to one another to an open position in which the panels are substantially parallel and in line with one another, the first hinge leaf having at least one angular appendage adapted to extend across a front panel edge of the first panel, and the second hinge leaf having at least one angular appendage adapted to extend across a front panel edge of the second panel, said first hinge pin bore being provided within a first free end of the angular appendage of the first hinge leaf and said second hinge pin bore being provided within a second free end of the angular appendage of the second binge leaf, said first free end and said second free end being laterally offset from one another, wherein the first and second hinge leaves are each in the form of an elongated supporting arm, said first hinge leaf being adjustably held on a first mounting plate and said second hinge leaf being adjustably held on a second mounting plate, said first mounting plate being fastenable on an inside face of the first panel and said second mounting plate being fastenable on an inside face of the second panel, said first hinge leaf comprising a first link associated therewith and said second leaf comprising a second link associated therewith, a first end of said first link being articulated to the first hinge leaf and a first end of said second link being articulated to the second hinge leaf, and a second end of each of said first and second links being coupled to one another, at least one of said first and second links being articulated at the first end thereof to a thruster at an articulation point thereof, the thruster being guided for displacement in the direction of its length up to an end point defined by an abutment means, and being resiliently biased towards an end position located opposite said articulation point, the length of each of said first and second links being such that in an outstretched, substantially aligned position associated with the closed position of the door, the first and second panels are held in the position at approximately right angles to one another, while an additional swing of the second, free panel to an intermediate open position is possible wherein the first and second panels are at an angle of less than 90° as limited by the abutment means of the thruster, each of said first and second links being arranged such that when the first and second hinge leaves move from an angled position associated with a closed position of the door to an outstretched, substantially aligned position associated with an open position of the door, the first and second links move from an outstretched, substantially aligned position to a position wherein the first and second links move toward each other and the second end of the first link moves away from the first hinge leaf while the second end of the second link moves away from the second hinge leaf.

2. Hinge according to claim 1, wherein the second hinge leaf and the first hinge leaf hung on the carcase are of identical configuration.

3. Hinge according to claim 1 or 2, wherein each of the at least one angular appendages (34) each have two parallel spaced-apart knuckles (34*a*, 34*b*) between which there is an interval that is slightly greater than the width of one of the knuckles.

4. Hinge according to claim 3, wherein one (34*a*) of the knuckles (34*a*, 34*b*) of each hinge leaf is disposed laterally in line with a side flange of each supporting arm, while the other of the knuckles is offset outwardly from the other side flange.

5. Hinge according to claim 1, wherein the thruster is disposed for longitudinal displacement in an end portion of at least one supporting arm adjacent the angular appendage, and wherein one end of the thruster protrudes through an opening (44) in the at least one supporting arm in a first position, and the link (60) articulated to the thruster is journaled on an axis parallel to a pivoting axis of the hinge (20), and the thruster (42) is biased by a pre-tensioned spring located in an interior of the thruster, the thruster being in turn located in an interior of the at least one supporting arm, whereby the thruster can be displaced from the first position to a second position largely withdrawn into the supporting arm (24).

6. Hinge according to claim 5, wherein the spring is a coil spring (46) held under compressive bias between a transverse wall of the thruster remote from the angular appendage and a spring support means of the at least one supporting arm.

7. Hinge according to claim 6, wherein the spring support means is formed by a pin (48) held between opposing lateral flanges of the at least one supporting arm (24) and running transversely of the supporting arm.

8. Hinge according to claim 1, wherein said at least one of the links has at its first end attached to the thruster two bearing ears (58) straddling the thruster (42), the two bearing ears each having bores (56) aligned with a bore (52) provided in the thruster (42) at the articulation point, and wherein both the thruster bore and the bearing ears bores are journaled on a common pivot pin (54).

9. Hinge according to claim 8, wherein the first and second links are generally flat and elongated, and wherein the bearing ears are of a thickened dimension to allow for the location therethrough of lateral bores.

10. Hinge according to claim 1, wherein at each of the second end of the first link and the second end of the second link, two laterally spaced apart bearing lugs are provided whose distance apart is about equal or only slightly greater than their width, and wherein the bearing lugs of each of said first and second links are offset laterally from a longitudinal central axis of that link such that the longitudinal central axes of each of the said first and second links articulated together are aligned by a pin passing through bearing bores in the each of the bearing lugs.

11. Hinge according to claim 10, wherein the first and second links (60) are generally flat and elongated, and wherein the bearing lugs bearing and ears are of a thickened dimension to allow for the location therethrough of lateral bores.

12. Hinge according to claim 1, wherein on the second end of at least one of said first and second links, an abutment is provided which comes in contact with the second end of an other one of said first and second links when the first and second links are in an outstretched, substantially aligned position associated with the closed position of the panels, such that the first and second links are prevented by the abutment from deflecting towards the respective first and second panels further than said substantially aligned position, while the first and second links are permitted to deflect away from the respective first and second panels as the panels are moved towards the open position.

* * * * *